US006755940B2

(12) United States Patent
Lin et al.

(10) Patent No.: US 6,755,940 B2
(45) Date of Patent: Jun. 29, 2004

(54) METHOD AND APPARATUS FOR CALIPER CONTROL OF A FIBROUS WEB

(75) Inventors: Philip S. Lin, Oshkosh, WI (US); Paul Bartocci, Bear, DE (US); Pat Samolinski, Winneconne, WI (US); Lynn Matheus, Appleton, WI (US); Peter J. Allen, Neenah, WI (US); Mary M. Zielinski, Boothwyn, PA (US); Kenneth F. Arni, Fenwick Island, DE (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/029,129

(22) Filed: Dec. 20, 2001

(65) Prior Publication Data

US 2003/0116296 A1 Jun. 26, 2003

(51) Int. Cl.[7] ..... D21G 1/00; B29C 43/24

(52) U.S. Cl. ..... 162/205; 162/198; 162/252; 162/283; 162/109; 162/118; 100/163 A

(58) Field of Search ..... 162/109, 116, 162/117, 118–122, 205, 206, 198, 263, 361, 362, 360.3, 360.2, DIG. 10, 283–285, 252–254; 700/127–129; 242/534, 534.2, 547, 563.2, 541.1, 541.4, 541.5; 100/40, 47, 76, 155 R, 168, 162 R, 164, 163 A, 163 R

(56) References Cited

U.S. PATENT DOCUMENTS

| | | | | |
|---|---|---|---|---|
| 4,431,140 A | | 2/1984 | Tetro | |
| 4,573,402 A | * | 3/1986 | Sharma et al. | 100/38 |
| 4,583,697 A | * | 4/1986 | Bichot et al. | 242/534 |
| 4,921,574 A | * | 5/1990 | Hu | 162/198 |
| 5,607,551 A | | 3/1997 | Farrington, Jr. et al. | |
| 5,656,132 A | | 8/1997 | Farrington, Jr. et al. | |

(List continued on next page.)

FOREIGN PATENT DOCUMENTS

| | | |
|---|---|---|
| JP | 06340370 | 12/1994 |
| WO | WO 9844195 | 10/1998 |
| WO | WO 9844196 | 10/1998 |
| WO | WO 9855384 | 12/1998 |
| WO | WO 9858124 | 12/1998 |
| WO | WO 9923305 | 5/1999 |
| WO | WO 0008253 | 2/2000 |
| WO | WO 0164559 | 9/2001 |
| WO | WO 01/73197 A1 | 10/2001 |

OTHER PUBLICATIONS

Patent Abstracts of Japan Publication No. 06340370 Dec. 13, 1994.

PCT International Search Report for International Application No. PCT/US02/37654 Mar. 21, 2003.

*Primary Examiner*—Steven P. Griffin
*Assistant Examiner*—Eric Hug
(74) *Attorney, Agent, or Firm*—Dority & Manning, P.A.

(57) ABSTRACT

A method for increasing caliper control of a fibrous web as the web is wound onto a roll is provided. The method includes winding the fibrous web containing cellulosic fiber onto the roll to form a wound product and conveying the web through a nip prior to winding the web onto the roll. The nip is configured to apply a pressure to the web to selectively decrease the caliper of the web as the web is wound onto the roll. Also disclosed is a system for controlling the caliper of the fibrous web in which a calender device forms a nip through which the fibrous web is conveyed. The system includes an adjustment device, which is configured to adjust the nip of the calender device to increase pressure on the fibrous web as the diameter of the roll increases thus increasing uniformity of the caliper of the fibrous web.

50 Claims, 3 Drawing Sheets

U.S. PATENT DOCUMENTS 5,743,177 A * 4/1998 Wostbrock ..... 100/47
5,746,887 A 5/1998 Wendt et al.
5,772,845 A 6/1998 Farrington, Jr. et al.
5,845,868 A 12/1998 Klerelid et al.
5,901,918 A 5/1999 Klerelid et al.
5,904,812 A 5/1999 Salman et al.
5,932,068 A 8/1999 Farrington, Jr. et al.
5,944,273 A 8/1999 Lin et al.
5,988,557 A * 11/1999 Moller et al. ..... 242/532
6,017,417 A 1/2000 Wendt et al.
6,036,137 A * 3/2000 Myren ..... 242/541.7
6,098,510 A 8/2000 Hada et al.
6,171,442 B1 1/2001 Farrington, Jr. et al.
6,183,601 B1 2/2001 Otto et al.
6,187,137 B1 2/2001 Druecke et al.
6,264,793 B1 7/2001 Ojala et al.

* cited by examiner

METHOD AND APPARATUS FOR CALIPER CONTROL OF A FIBROUS WEB

BACKGROUND OF THE INVENTION

Large parent rolls of raw material are presently rolled up on a reel after a web manufacturing process. The parent rolls, such as paper, tissue, composite, or like web, are prepared, stored and eventually transported for subsequent finishing and conversion to a final product. In a typical converting process, the parent roll is unwound at one end of a processing line, and is processed through the processing line to thereby convert the raw material, such as to shorter or narrower rolls of product; or to shape products from the raw material, to separate products from the raw material, and/or to combine the raw material with other input elements to thereby create a product or product pre-cursor.

At least one drawback in the present state of the art is that thickness or sheet caliper across parent rolls formed from uncreped through-air dried (UCTAD) sheets may vary undesirably due to the relatively large diameters of parent rolls. Although the caliper difference problem is practically unnoticeable in manufacturing conventional wet pressed tissue wound on conventional tissue machine (TM) reels, caliper difference is a significant problem in high bulk products.

Large diameters typically cause different compressive stresses to the sheets in the parent roll at the top of the roll and approaching the core of the roll, which can result in significant difference in sheet caliper even after the sheets are converted into a finished product form. In particular, caliper difference in parent rolls for high bulk soft tissue can result in significant differences in the consistency of finished rolls, which not only impacts on the real and perceived qualities of the product but can impair converting line runnability and production efficiency.

SUMMARY OF THE INVENTION

The present invention provides a system for controlling the caliper of a fibrous web during winding operations, an apparatus for controlling the caliper of a fibrous web and methods for increasing caliper control of a fibrous web. The component parts of the present invention are simple, reliable, and economical to manufacture, assemble, and use. Other advantages of the invention will be apparent from the following description and the attached drawings or can be learned through practice of the invention.

Notably, the fibrous web discussed herein, such as a tissue web used to manufacture a tissue product, can generally be formed by any of a variety of papermaking processes known in the art. In fact, any process capable of forming a paper web can be utilized in the present invention. For example, a papermaking process of the present invention can utilize adhesive creping, wet-creping, double-creping, embossing, wet-pressing, air-pressing, through-air drying, creped through-air drying, uncreped through-drying, as well as other steps in forming the paper web. Some examples of such techniques are disclosed in U.S. Pat. No. 5,048,589 to Cook, et al., U.S. Pat. No. 5,399,412 to Sudall. et al., U.S. Pat. No. 5,129,988 to Farrington. Jr. and U.S. Pat. No. 5,494,554 to Edwards, et al., which are incorporated herein by reference.

According to an aspect of the invention, a method for increasing caliper control of a cellulosic fiber-containing web as the web is wound onto a roll is disclosed. The method includes the step of winding a fibrous web onto a roll to form a wound product. Prior to begin wound, the web is conveyed through a nip. The nip is configured to apply a pressure to the web and to selectively decrease the caliper of the web by increasing the pressure. Specifically, the nip pressure is increased as the diameter of the wound product increases in order to compensate for the caliper reduction that occurs in the web near the center of the wound roll due to compressive forces that are excited on the web as the diameter of the roll increases.

In one aspect of the invention, the pressure may be applied manually via a set of calender rolls in which the calender rolls are incrementally moved toward the web as the parent roll is formed. For instance, the calender rolls may be controlled by a human operator to move the calender roll toward the web. This control could be accomplished in various ways (i.e., pneumatic and hydraulic cylinders, block and tackle weights, embossing wedges, etc.).

Alternatively, an open loop control of the nip pressure may be employed in which, for example, a mathematical computer algorithm automatically increases the pressure as functions of time, reel length or roll diameter. More specifically, the algorithm can be programmed to automatically adjust the nip pressure over time, with the use of, e.g., a flow meter, a length of passing web, or when a diameter is physically reached.

Another exemplary embodiment may incorporate an on-line caliper sensor to allow a closed-loop feedback control of web caliper. This aspect of the invention may be dependent on the building diameter of the parent roll, which may be determined by the steps of monitoring the caliper of the fibrous web with a sensing device and then adjusting the pressure based on measurements of the caliper from the sensing device. Optionally, the sensing device can be supplemented by a computer to automatically adjust the calender gap or nip pressure in precise micro-adjustments as a function of the building roll diameter D. Alternatively stated, a remote computer can be configured to send commands to adjust the calender roll in small increments toward the web as the diameter of the parent roll increases.

According to another aspect of the invention, nip pressure to a tissue may occur in a converting line as the tissue is being unwound from the parent roll and wound onto a secondary roll or onto a packaging roll. The method may comprise the steps of monitoring the caliper of the tissue with a sensor and controlling the pressure of, for instance, a calendering device, based on measurements of the caliper from the sensor. In effect, the monitoring and controlling steps form a closed-looped feedback similar to the foregoing closed-looped description.

Other aspects and advantages of the invention will be apparent from the following description and the attached drawings, or can be learned through practice of the invention.

BRIEF DESCRIPTION OF THE DRAWINGS

The above and other aspects and advantages of the present invention are apparent from the detailed description below and in combination with the drawings in which.

Figure 1:
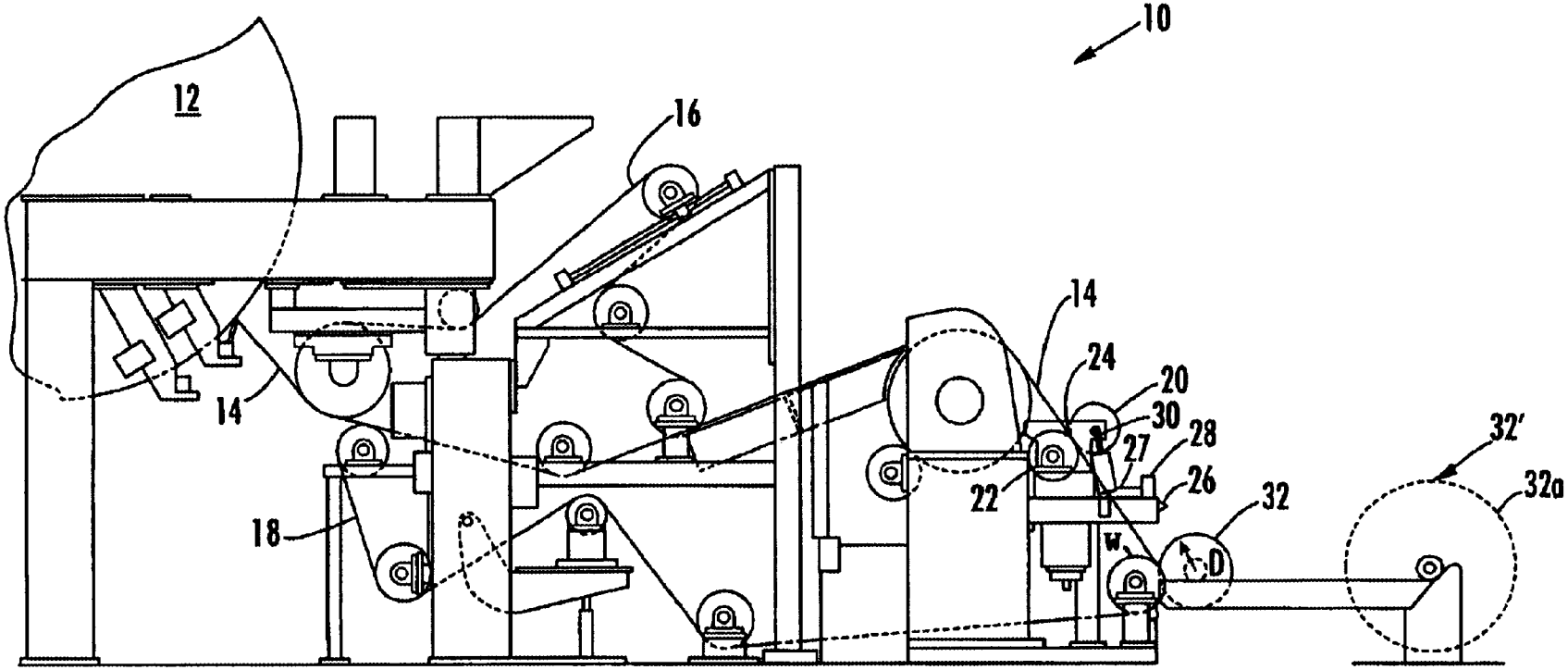
FIG. 1 is a side view of an embodiment of a system for manufacturing a tissue product in the form of a parent roll in which a caliper of the tissue product is controlled according to the invention.

Repeat use of reference characters in the present specification and drawings is intended to represent same or analogous features or elements of the invention.

DETAILED DESCRIPTION OF THE DRAWINGS

Detailed reference will now be made to the drawings in which examples embodying the present invention are shown. The drawings and detailed description provide a full and detailed written description of the invention and the manner and process of making and using it, so as to enable one skilled in the pertinent art to make and use it. The drawings and detailed description also provide the best mode of carrying out the invention. However, the examples set forth herein are provided by way of explanation of the invention and are not meant as limitations of the invention. The present invention thus includes modifications and variations of the following examples as come within the scope of the appended claims and their equivalents.

As broadly embodied in the Figures, a manufacturing system for controlling the caliper of a fibrous web is provided.

Figure 2:
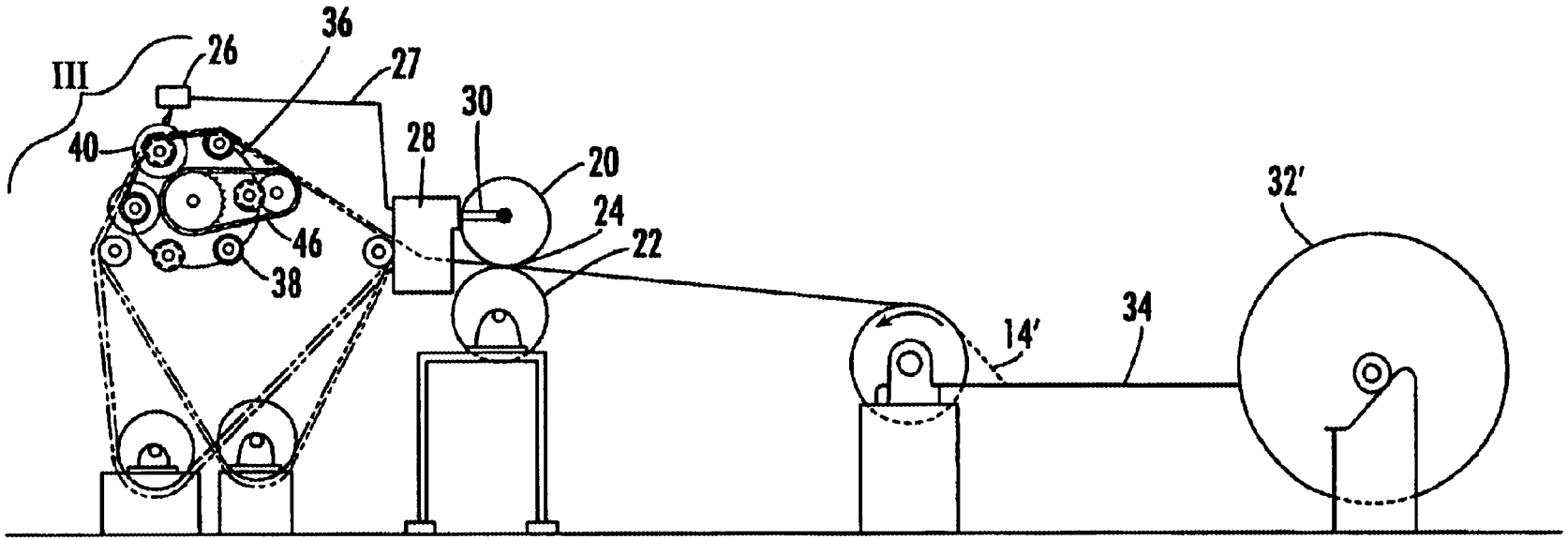
FIG. 2 is a side view of another embodiment showing caliper control of a finished tissue product in accordance with the invention.
Figure 3:
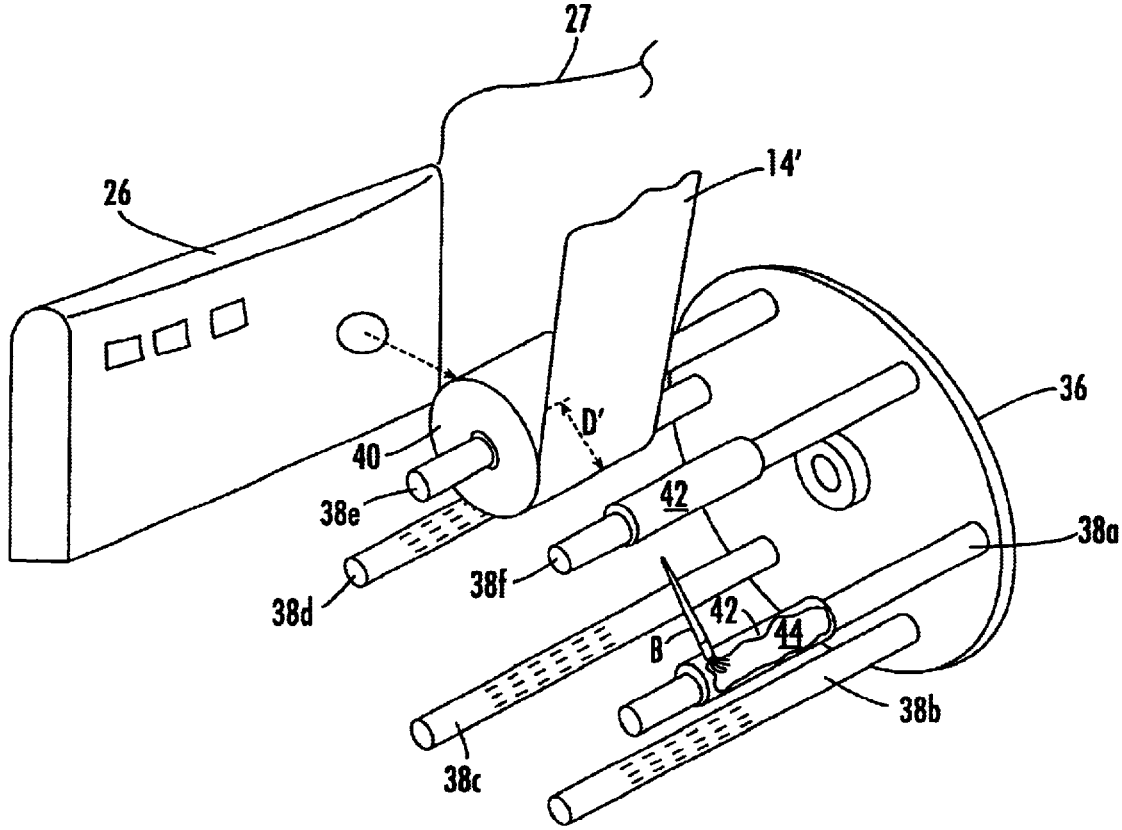
FIG. 3 is an enlarged perspective view of a section of the invention taken at area III in FIG. 2 showing a caliper sensor in accordance with the invention.

Referring to FIG. 1, one embodiment of the present invention is shown. A system 10 includes a dryer 12 such as a Yankee or through-air dryer, a first conveyor 16 and a second conveyor 18, which cooperate to pass a web 14 from the dryer 12 in the direction of a calendering device such as calender roll 20. Calender roll 20 optionally cooperates with a complimentary calender roll or reel 22 to form an open gap or closed nip 24 to apply pressure to a first side and a second side of web 14 as web 14 passes on its way to forming a parent roll 32. The invention contemplates positioning calender roll 20 and reel 22 after dryer 12 and before parent roll 32, or calender roll 20 and reel 22 may be in a converting line following an unwinding parent roll 32' and before a system such as turret 36 for packaging finished product rolls 40 as seen in FIGS. 2 and 3.

As the parent roll 32 is wound and formed in accordance with FIG. 1, a diameter D of the parent roll 32 is monitored and measured by a sensor 26, such as a non-contact laser thickness sensing device or electro-optic sensor. For instance, sensor 26 may be a caliper-sensing device, which measures the caliper of the fibrous web 14 as the web 14 is wound onto the roll 32 to feed back information for regulating the nip pressure generated by calender roll 20 and reel 22.

Alternatively or additionally, sensor 26 may be a contact-type caliper sensor such as a roll-sensing device, which monitors the diameter D of the parent roll as the fibrous web 14 is wound onto the parent roll to feed back information for regulating the nip pressure generated by calender roll 20 and reel 22.

The system 10 may include an adjustment or control device 28, which is operably linked to an adjustment apparatus or arm 30. The control device 28 may remotely or directly control the adjustment arm 30 to alter the nip 24 in micro-increments. Specifically, as the sensor 26 senses the increasing diameter D of parent roll 32, sensor 26 can signal the control device 28, which then directs the adjustment arm 30 to move calender roll 20 towards reel 22 such that the nip pressure in the nip 24 is increased. In other words, a gap (not shown) is decreased and/or nip 24 is further compressed as the diameter D of parent roll 32 increases. The adjustment device 28 can be a programmable controller, such as a microprocessor or a PLC device.

Although FIG. 1 shows sensor 26 monitoring diameter D, alternative embodiments are contemplated by the present invention. For instance, no sensor is required if nip pressure is a function of an operating time of the system 10. Specifically, control device 28 can be programmed to increase nip pressure at predetermined intervals over a preselected system operating time. Alternatively, a trial and error method of caliper control may be utilized in lieu of sensor 26. For instance, a parent roll may be produced, wound and subsequently unwound. The sheet caliper is measured as the parent roll is unwound and caliper variances recorded. Control device 28 or other computer mechanism may then be programmed to apply corresponding nip pressures on subsequent parent roll formations to equalize the caliper variances.

FIG. 1 further indicates that once parent roll 32 is formed with a uniform caliper, the formed parent roll 32' may be moved in a direction away from system 10 such that formed parent roll 32' does not interfere with the formation of a subsequent parent roll.

With reference to FIGS. 2 and 3, an aspect of the invention is shown in which the formed parent roll 32' is unwound along a third conveyor 34 in the direction of the carousel or turret 36 to form the finished rolled product 40. With particular reference to FIG. 2, the unwound web 14' is conveyed through calender roll 20 and complimentary reel 22, which again cooperate to form nip 24. Also similar to the previously described embodiment, sensor 26 in FIG. 3 senses a diameter D' of the building rolled web product 40. The diameter D' is then communicated by wiring 27, for example, to pressure adjustment device 28, which in turn adjusts the adjusting arm 30 to decrease the gap (not shown) or further compress nip 24 and increase pressure on the web 14' to maintain a uniform caliper on the forming tissue product 40.

Optionally, a center-winding device W may be disposed downstream from the calender rollers 20, 22 in the direction of travel of web 14. The center-winding device W may have a cylinder extending therefrom onto which a roll may be placed, and a setting device is provided with the calender rollers 20, 22 to permit control of the nip pressure to increase uniformity of the tissue caliper as the web 14 is wound onto the roll 32 from a core region (not shown) of the roll 32 to an outer region of the roll 32*a*.

The optional turret assembly 36, shown with particularity in FIG. 3, includes at least one mandrel 38*a* that is rotatably affixed to the turret 36 for winding the web product 14' into the finished product 40. Six mandrels 38*a–f* are rotatably affixed to turret 36 as seen in FIGS. 2 and 3, but it should be understood that only one mandrel or any number of mandrels greater than one can also be used in the present invention. Additionally, turret 36 as well as other elements of the invention, may be shaped other than as shown such as square, irregular, pentagonal, etc. and be within the scope of the invention.

FIGS. 2 and 3 illustrate that once finished product 40 is rolled to its desired diameter D' as sensed by sensor 26, the turret 36 may be rotated by a chain 46 or similar mechanism to move the mandrel 38*e* and finished product 40 to provide a fresh mandrel 38*f* with a core 42 on which the web 14' may be wound into another formed product 40. FIG. 3 further illustrates that an adhesive 44 can be applied to core 42 to attach web 14' prior to being wound into formed product 40. Adhesive 44 may be any type of glue or other attachment as known in the art and may be applied to the core 42 in a well-known manner such as by a brush mechanism B.

FIGS. 1–3 further illustrate a method of operation of one embodiment of the invention. Specifically, FIG. 1 depicts a method for increasing caliper control of the fibrous web 14 as the web 14 is wound onto roll 32 includes the steps of winding fibrous web 14 to form parent roll 32 which subsequently may form wound product 40.

In this example method, the web 14 may be conveyed through nip 24 prior to winding the web 14 onto the parent roll 32. The nip 24 is configured to apply a pressure to the web 14 to selectively decrease the caliper of the web 14. The calender roll 20 and reel 22 cooperate to apply the pressure as the web 14 is wound onto the parent roll 32.

As FIG. 2 indicates, an alternative method may include applying the pressure to the fibrous web 14' in a converting line as the fibrous web 14' is unwound from parent roll 32' and wound into a secondary roll or formed tissue product 40. Similar to the foregoing descriptions, the nip pressure may be applied as a function of sensed diameter D' of the finished product 40 or applied by open or closed loop feedback methods or by other manual methods.

It should be appreciated that the present invention has utility for adjusting the caliper of any type of web material and that the type of web material does not in any way limit the invention.

While preferred embodiments of the invention have been shown and described, those skilled in the art will recognize that other changes and modifications may be made to the foregoing embodiments without departing from the scope and spirit of the invention. For example, specific shapes of various elements of the illustrated embodiments may be altered to suit particular applications. It is intended to claim all such changes and modifications as fall within the scope of the appended claims and their equivalents.

That which is claimed is:

1. A method for increasing caliper control of a fibrous web as the web is wound onto a roll, the method comprising the steps of:

winding a fibrous web onto a roll to form a wound product, the web containing cellulosic fiber;

conveying the web through a nip prior to winding the web onto the roll, the nip applying a pressure to the web, the nip being configured to selectively decrease the caliper of the web by increasing the pressure of the nip;

applying the pressure as the web is wound onto the roll to influence caliper of the fibrous web; and adjusting the pressure applied to the web by the nip as the web is wound onto the roll wherein the nip pressure is increased as the diameter of the wound product is increased in order to compensate for caliper reduction in the web as the diameter of the wound product increases.

2. The method as in claim 1, wherein applying the pressure to the fibrous web occurs afler a paper making process and before the web is wound onto a parent roll.

3. The methad as in claim 1, wherein applying the pressure to the fibrous web occurs in a convening line as the fibrous web is being unwound from a parent roll and wound onto a secondary roll.

4. The method as in claim 1, wherein applying the pressure to the fibrous web occurs as the fibrous web is being unwound from a roll and onw a packaging roll.

5. The method as in claim 1, wherein the pressure is dependent on the diameter of the roll.

6. The method as in claim 1, further comprising the steps of monitoring the caliper of the fibrous web with a sensing device and adjusting the pressure based on measurements of the caliper from the sensing device.

7. The method as in claim 1, wherein the pressure to the fibrous web is applied by a calender roll.

8. The method as in claim 1, wherein the pressure to the fibrous web is applied by a converting line calender rolls the converting line calender roll configured to sense the caliper and operable to control the caliper via a closed-loop feedback.

9. The method as in claim 1, wherein the pressure to the fibrous web can be adjusted remotely in precise micro-adjustments.

10. A method for increasing caliper control of a tissue the method comprising the steps of:

providing a tissue having a first side and a second side, the tissue to be wound onto a roll;

controlling a pressure that a calendering device applies to the tissue in such a manner that the pressure increases uniformity of caliper of the tissue being wound onto the roll from a core region of the roll to an outer region of the roll;

applying the pressure to at least one of the sides of the tissue with the calendering device; and winding the tissue onto the roll after the pressure is applied to the tissue by the calendering device.

11. The method as in claim 10, wherein the pressure increases as a diameter of the roll increases.

12. The method as in claim 11, further comprising the step of measuring the diameter of the roll to determine the adjustment to the pressure as the tissue is wound onto the roll.

13. The method as in claim 10, wherein applying the pressure to the tissue occurs after a tissue machine and before the tissue is wound onto a parent roll.

14. The method as in claim 10, wherein applying the pressure to the tissue occurs in a converting line as the tissue is being unwound from a parent roll and wound onto a secondary roll.

15. The method as in claim 10, wherein applying the pressure to the tissue occurs as the tissue is being unwound from a roll and onto a packaging roll.

16. The method as in claim 10, further comprising the steps of monitoring the caliper of the tissue with a sensor and controlling the pressure based on measurements of the caliper from the sensor.

17. The method as in claim 16, wherein the monitoring and controlling steps form a closed-looped feedback process.

18. The method as in claim 10, wherein the pressure to the fibrous web is applied by a set of calender rollers.

19. The method as in claim 18, wherein the pressure to the fibrous web can be adjusted remotely in precise micro-adjustments.

20. The method as in claim 10, wherein the roll is wound on a center-winding device.

21. A system for controlling the caliper of a fibrous web, the system comprising:

a calender device having a reel and a roll that forms a nip through which the fibrous web is conveyed, the nip of the calender device applying pressure to a first side and a second side of the fibrous web;

wherein the reel is disposed within an operable distance to the roll, the reel having a cylindrical surface extending in an axial manner;

wherein the roll is slidably disposable onto and removable from the cylindrical surface of the reel, the roll interacting with the fibrous web in a manner in which the fibrous web is wound onto the roll; and an adjustment device integrally disposed to the calender device, the adjustment device allowing the pressure created by the nip of the calender device to be adjusted to permit the pressure to increase on the first and second side of the fibrous web as diameter of the roll increases, thus increasing uniformity of the caliper of the fibrous web.

22. The system as claim 21, wherein the calender device forms an open gap.

23. The system as claim 21, wherein the calender device forms a closed nip.

24. The system as claim 21, further comprising a control device operably linked to the adjustment device, the control device remotely regulating the pressure generated by the nip of the calender device by controlling the adjustment device in such a manner that the adjustment device alters the nip in micro-increments as directed by the control device.

25. The system as claim 24, further comprising a roll sensing device in communication with the control device, the roll sensing device monitoring the diameter of the roll as the fibrous web is wound onto the roll to provide information for regulating the pressure generated by the nip of the calender device.

26. The system as claim 24, farther comprising a caliper sensing device in communication with the control device, the caliper sensing device measuring the caliper of the fibrous web as the fibrous web is wound onto the roll to provide information for regulating the pressure generated by the nip of the calender device.

27. The system as claim 26, wherein the caliper sensing device is a non-contact laser.

28. The system as claim 26, wherein the caliper sensing device is a contact sensor.

29. The system as in claim 21, wherein the calender device is positioned after a tissue machine and before a reel for a parent roll.

30. The system as in claim 21, wherein the calender device is positioned in a converting line between a reel for a parent roll and a reel for a secondary roll.

31. The system as in claim 21, wherein the calender device is positioned before a reel for a packaging roll.

32. The system as in claim 21, wherein the reel is a center-winding device.

33. The system as in claim 21, wherein calender device is a set of calender rollers.

34. An apparatus for controlling the caliper of a tissue, the apparatus comprising:

a set of calender roller forming a nip, the calender rollers transporting the tissue through the nip and applying pressune to the tissue;

a center-winding device disposed downstream from the calender rollers in the tissue's direction of travel, the center-winding device having a cylinder extending therefrom onto which a roll may be placed; and a setting device configured with the calender rollers, the setting device permitting control of the pressure created by the calender rollers on the tissue in such a manner that the pressure increases uniformity of caliper of the tissue being wound onto the roll from a core region of the roll to an outer region of the roll.

35. An apparatus as claim 34, further comprising a control apparatus in communication with the setting deviee, the control apparatus remotely regulating the calender rollers by instructing the setting device to adjust the calender rollers in micro-increments, thereby controlling the pressure the calender rollers place upon the tissue.

36. An apparatus as claim 35, further comprising a caliper sensor operably linked to the control apparatus, the caliper sensor determining the caliper of the tissue as the tissue is wound onto the roll and communicating the caliper to the control apparatus for regulating the pressure generated by the calender rollers.

37. An apparatus as claim 36, wherein the caliper sensor is a non-contact laser.

38. An apparatus as claim 36, wherein the caliper sensor is a contact sensor contacting the tissue.

39. An apparatus as claim 35, further comprising a roll thickness sensor in communication with the control apparatus, the roll thickness sensor measuring the diameter of the roll as the tissue is wound onto the roll and communicating the diameter to the control apparatus for regulating the pressure generated by the calender rollers.

40. An apparatus as in claim 34, wherein the calender rollers are positioned after a tissue machine and before a center-winding device for a parent roll.

41. An apparatus as in claim 34, wherein the calender rollers are positioned in a converting line between a center-winding device for a parent roll and a center-winding device for a secondary roll.

42. An apparatus as in claim 34, wherein the calender rollers are positioned before a center-winding device for a packaging roll.

43. An apparatus as in claim 34, wherein the center-winding device is a center-winding reel.

44. An apparatus as claim 34, wherein the calender rollers forms an open gap.

45. An apparatus as claim 34, wherein the calender rollers forms a closed nip.

46. A method for increasing caliper control of a fibrous web as the web is wound onto a roll, the method comprising the steps of:

winding a fibrous web unto a roll to form a wound product, the web containing cellulosic fiber;

conveying the web through a nip prior to winding the web onto the roll, the nip applying a pressure to the web, thc nip being configured to selectively decrease the caliper of the web by increasing the pressure of the pip;

applying the pressure as the web is wound onto the roll to influence caliper of the fibrous web;

adjusting the pressure applied to the web by the nip as the web is wound onto the roll wherein the nip pressure is increased as the diameter of the wound product is increased in order to compensate for caliper reduction in the web as the diameter of the wound product increases; and monitoring the caliper of the fibrous web with a sensing device and adjusting the pressure based on measurements of the caliper from the sensing device.

47. A method for increasing caliper control of a fibrous web as the web is wound onto a roll, the method comprising the steps of:

winding a fibrous web onto a roll to form a wound product, the web containing cellulosic fiber;

conveying the web through a nip configured to apply a pressure to the web and further configured to selectively decrease or increase the caliper of the web by increasing or decreasing the pressure;

applying the pressure as the web is wound onto or unwound from the roll to influence caliper of the fibrous web; and adjusting the pressure applied to the web by the nip as the web is wound onto or unwound from the roll, wherein the nip pressure is respectively increased as the diameter of the wound product is increased in order to compensate for caliper reduction in the web as the diameter of the wound product increases, and the nip pressure is decreased as the web is unwound from the roll onto a packaging roll.

48. A method for increasing caliper control of a tissue the method comprising the steps of:

providing a tissue having a first side and a second side, the tissue to be wound onto a roll;

controlling a pressure that a calendering device applies to the tissue in such a manner that the pressure increases uuiformity of caliper of the tissue being wound onto the roll from a core region of the roll to an outer region of the roll;

applying the pressure to at least one of the sides of the tissue with the calendering device;

winding the tissue onto the roll after the pressure is applied to the tissue by the calendering device; and monitoring the caliper of the tissue with a sensor and controlling the pressure based on measurements of the caliper from the sensor.

49. A method for increasing caliper control of a tissue the method comprising the steps of:

providing a tissue having a first side and a second side, the tissue to be wound onto a roll:

controlling a pressure that a calendering device applies to the tissue in such a manner that the pressure increases uniformity of caliper of the tissue being wound onto the roll from a core region of the roll to an outer region of the roll;

applying the pressure to at least one of the sides of the tissue with the calendering device;

winding the tissue onto the roll after the pressure is applied to the tissue by the calendering device; and applying the pressure to the tissue occurs as the tissue is being unwound from a roll and onto a packaging roll.

50. An apparatus for controlling the caliper of a tissue, the apparatus comprising:

a set of calender rollers forming a nip, the calender rollers transporting the tissue through the nip and applying pressure to the tissue;

a center-winding device disposed downstream from the calender rollers in the tissue's direction of travel, the center-winding device having a cylinder extending therefrom onto which a roll may be placed;

a setting device configured with the calender rollers, the setting device permitting control of the pressure created by the calender rollers on the tissue in such a manner that the pressure increases uniformity of caliper of the tissue being wound onto the roll from a core region of the roll to an outer region of the roll;

a control apparatus in communication with the setting device, the control apparatus remotely regulating the calender rollers by instructing the setting device to adjust the calender rollers in micro-increments, thereby controlling the pressure the calender rollers place upon the tissue; and a caliper sensor operably linked to the control apparatus, the caliper sensor determining the caliper of the tissue as the tissue is wound onto the roll and communicating the caliper to the control apparatus for regulating the pressure generated by the calender rollers.

* * * * *

UNITED STATES PATENT AND TRADEMARK OFFICE

CERTIFICATE OF CORRECTION

PATENT NO. : 6,755,940 B2
DATED : June 29, 2004
INVENTOR(S) : Philip S. Lin et al.

It is certified that error appears in the above-identified patent and that said Letters Patent is hereby corrected as shown below:

Column 5,
Line 51, please replace “afler” with -- after --
Line 53, please replace “methad” with -- method --
Line 54, please replace “convening” with -- converting --
Line 59, please replace “onw” with -- onto --

Column 6,
Line 2, please replace “rolls the” with -- roll, the --

Column 7,
Line 48, please replace “pressune” with -- pressure --
Line 60, please replace “deviee” with -- device --

Column 8,
Line 38, please replace “pip” with -- nip --

Column 9,
Line 10, please replace “uuiformity” with -- uniformity --

Signed and Sealed this

Thirtieth Day of November, 2004

JON W. DUDAS
*Director of the United States Patent and Trademark Office*